US006215410B1

(12) United States Patent
Singer et al.

(10) Patent No.: US 6,215,410 B1
(45) Date of Patent: Apr. 10, 2001

(54) RESCUE GUILDING SYSTEM

(76) Inventors: Asher Singer; Andy Steenkamp, both of PO Box 1873, Pretoria (ZA), 0127

( * ) Notice: Subject to any disclaimer, the term of this patent is extended or adjusted under 35 U.S.C. 154(b) by 0 days.

(21) Appl. No.: 09/496,502

(22) Filed: Feb. 2, 2000

(51) Int. Cl.[7] ..... G08B 5/00

(52) U.S. Cl. ..... 340/815.4; 340/330; 340/331; 340/573.4; 340/825.49; 340/991; 340/993; 701/211

(58) Field of Search ..... 340/815.4, 991, 340/992, 628, 993, 995, 539, 996, 994, 573.4, 201, 214, 321, 330, 331, 985, 10.34, 10.31, 825.49; 701/211, 210, 209, 201; 455/40, 41

(56) References Cited

U.S. PATENT DOCUMENTS 5,898,363 * 4/1999 Altilio ..... 340/384.1
5,900,817 * 5/1999 Olmassakian ..... 340/573.1
6,028,513 * 2/2000 Addy ..... 340/539
6,075,442 * 4/1999 Welch ..... 340/573.1

* cited by examiner

*Primary Examiner*—Edward Lefkowitz
*Assistant Examiner*—Davetta W. Goins
(74) *Attorney, Agent, or Firm*—Lloyd L. Zickert

(57) ABSTRACT

A rescue guiding system for underground mine personnel to guide the movement of a person during hazardous life-threatening situations from a work area through a passage-way to a refuge bay, including a network of short-range radio transmitters each transmitting a different digitally coded signal and a receiver for each person having an indication device to guide the person in the correct direction to reach the refuge bay.

16 Claims, 2 Drawing Sheets

RESCUE GUILDING SYSTEM

DESCRIPTION

This invention relates in general to a rescue guiding system for underground mine personnel, and more particularly to a system for guiding persons during hazardous life-threatening situations from a work area to a refuge bay, and still more particularly to a wireless communication system for mine workers to guide them to a refuge bay.

BACKGROUND OF THE INVENTION

It is well known that in underground mines fire constitutes an ever-present life-threatening hazard to workers. Fires endanger valuable lives of workers and also cause considerable economic losses to the mine operators. Fires occur because of the presence of combustible materials and the use of various mining equipment and techniques, open flames, blasting operations, inadvertent explosions, the use of electricity, the occurrence of friction between various elements, the occurrence of spontaneous combustion, and other possibilities. The product of fires generates smoke and carbon monoxide, both of which are life threatening to workers. It is well known that mine workers carry emergency gear such as oxygen equipment which must be immediately activated in the event of a hazardous situation, and that the workers must evacuate their stations to go to the nearest shelter or refuge bay having life-support equipment and supplies.

It is also well known that the normal life of oxygen equipment carried by a person is about 25 to 30 minutes, but inasmuch as a worker would have a very short time to reach the refuge bay the adrenalin generated in the body due to anxiety substantially reduces the normal life of oxygen equipment.

Additionally, very thick smoke associated with the fire reduces visibility to substantially zero and walking in complete darkness can cause a person to lose orientation as to the correct direction to take to reach a refuge bay before depleting the emergency equipment oxygen supply.

Heretofore, the common practice of evacuating a work station such as the face area in a coal mine would be to follow a conveyer in a passage until reaching a turning point of a branch going to a refuge bay. The turning point would normally be indicated in the form of a brick wall, a rope, or other suitable structure.

If a path along a conveyer run is blocked, another safe way to the refuge bay would be through a return airway or ventilating passage.

Thus, the most significant obstacle facing mine safety management during substantially zero visibility due to thick smoke is providing the workers with a safe and reliable method of reaching the nearest refuge bay in the shortest possible time to preserve their lives.

Heretofore, it has been known to provide guiding ropes and sequential alarm systems for guiding workers to a refuge bay. However, these systems have not proven to be completely safe and reliable primarily because in substantially zero visibility conditions orientation for proceeding to the nearest refuge bay may be lost causing an undue amount of time to safely reach the refuge bay. It has been known that many lives have been lost due to the fact that workers could not find the refuge bay in a timely fashion because of thick smoke and loss of orientation. The present invention overcomes these problems to provide a safe and reliable system for directing workers from a work station to a refuge bay in the shortest possible time.

SUMMARY OF THE INVENTION

The rescue guiding system of the present invention includes a network of radio transmitters having short ranges and being mounted in a passageway for worker egress between a work station such as the face of a coal mine where coal is being suitably mined or a work station, and a shelter or refuge bay capable of providing life support to the workers during hazardous situations such as fires producing carbon monoxide and thick smoke. The transmitters generate and transmit a digitally coded signal to radio receivers carried by the workers. Each radio receiver includes an indication device that guides the workers' movement toward the refuge bay and indicates if that movement is correct. The indication device includes a plurality of light-emitting diodes (LED's) in a sequential order matching the sequential order of the network of transmitters marking the correct direction to the refuge bay. Additionally, the LED's may be provided with suitable indicia, such as sequential numbers and/or letters, which assists the worker in determining the direction of movement to take to safely reach the nearest refuge bay. Further, the LED's may be of different colors in order to highlight a transmitter at the refuge bay and/or a transmitter at a turning point from the passageway to a branch where the refuge bay is located.

The radio transmitters have short range and may be of varying ranges such as the transmitters mounted along a passageway having a range of between 80 and 100 meters, while the transmitters at the turning point and the refuge bay have a range not exceeding 50 meters.

Thus, the rescue guiding system of the present invention solves the problem heretofore known in underground mines of reliably directing workers to the nearest refuge bay.

An object of the present invention is to provide an improved rescue guiding system for guiding underground mine personnel to a safe area or refuge bay during life-threatening environmentally hazardous situations.

A further object of the present invention is to provide an accurate and effective rescue guiding system to a worker for guiding the worker from a work station to a refuge bay whether or not the worker is familiar with the direction to take going to the refuge bay.

A still further object of the present invention is to provide an improved rescue guiding system for underground mines to guide workers toward a refuge bay in the event of an emergency environmental situation by timely alerting and/or timely indicating the correct and/or incorrect direction to be taken by the worker to reach the nearest refuge bay.

A further object or the present invention is to provide a rescue guiding system for underground mining personnel that is simple in design and inexpensive to manufacture, precise in construction, easy to use and efficient in operation.

Other objects, features and advantages of the invention will be apparent from the following detailed disclosure, taken in conjunction with the accompanying sheets of drawings, wherein like reference numerals refer to like parts.

DESCRIPTION OF THE INVENTION

The present invention includes a network of short-range radio transmitters all operating on the same frequency but each having its own digital code to transmit on the frequency a preset digital coded signal and radio receivers carried by mine personnel for receiving the signals to operate an indication means. The receivers are responsive to the digital coded signals transmitted by the transmitters to identify on an indication device the location of the nearest radio transmitters, and thereby positively mark the correct direction for a worker to take when going from a work station to a refuge bay. Some of the transmitters have a shorter range than the others to differentiate locations along the transmitter network. The indication device of the receiver carried by a worker includes an array of light-emitting diodes (LED's) arranged so that in response to the various digitally coded signals of the transmitters the worker can when necessary correctly determine the direction to take to reach the nearest refuge bay.

Figure 1:
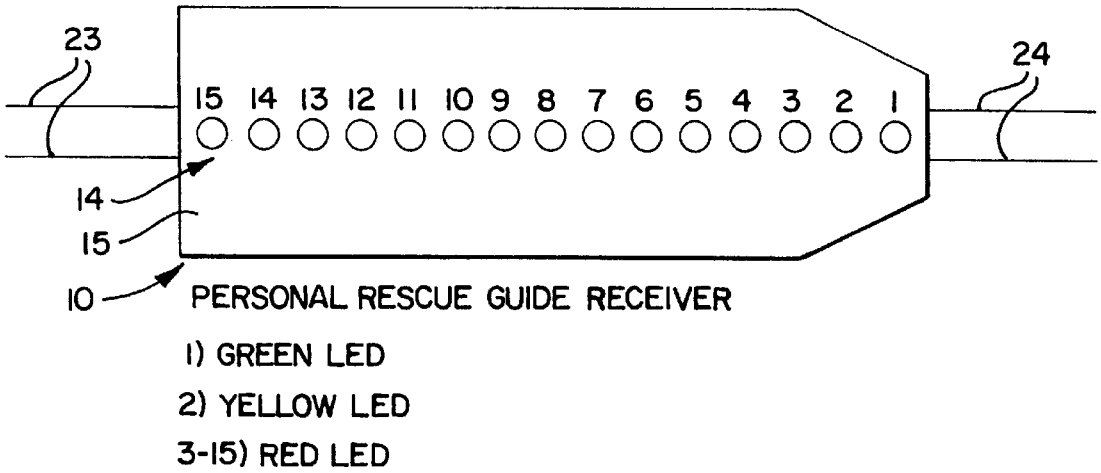
FIG. 1 is a somewhat diagrammatic view of a radio receiver to be worn by a worker and which will receive the digitally coded signals from the radio transmitters that are used in the system of the invention.
Figure 5:
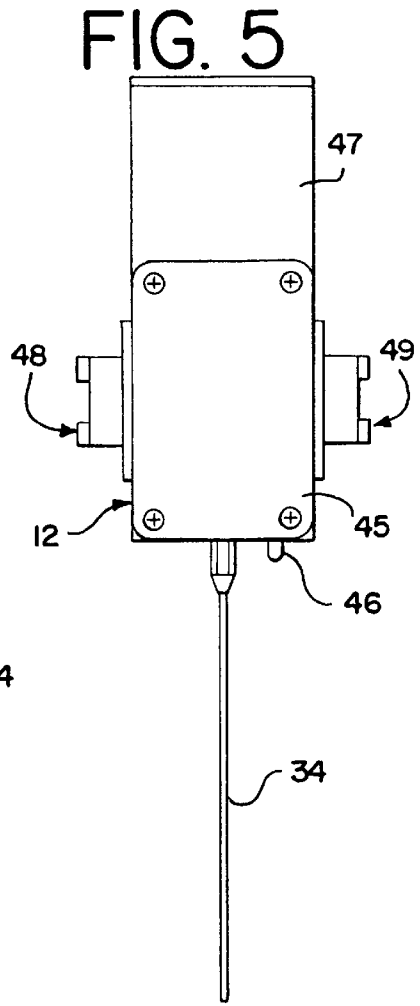
FIG. 5 is a plan view of a radio transmitter according to the present invention.

A radio receiver according to the invention is shown in FIG. 1 and generally indicated by the numeral 10, while a transmitter according to the invention is shown in FIG. 5 and generally indicated by the numeral 12. More particularly, the makeup of a radio receiver is illustrated in block form in FIG. 2, while the makeup of a radio transmitter is shown in block form in FIG. 4.

Each radio receiver includes a plurality of directional guiding LED's 14 mounted on a suitable panel 15 and sequentially arranged in an order corresponding to the setup of the network of radio transmitters as will be further explained below. While any number of Led's may be provided as long as the number corresponds to the number of radio transmitters, a series of 15 led's is shown on the panel 15. The LED's are marked with suitable indicia and in the illustrated embodiment with the numerals 1 to 15. However, they could be marked with other indicia such as letters if so desired.

It is also preferable that the LED's be colored and in the illustration of the invention LED No. 1 will be green, while LED No. 2 will be yellow, and LED's 3 to 15 will be red. LED No. 1 represents the radio transmitter at the refuge bay, while LED No. 2 represents the radio transmitter at the turning point from the passageway to the branch leading to the refuge bay. LED's Nos. 3 to 15 represent the spaced radio transmitters along the passageway which could be the same passageway that includes the conveyer for transporting the mined material or a ventilation passageway. A work station could be located anywhere along the location of the transmitters for energizing the LED's 3 to 15, such as at an area adjacent to where the radio transmitter 15 is located.

Figure 2:
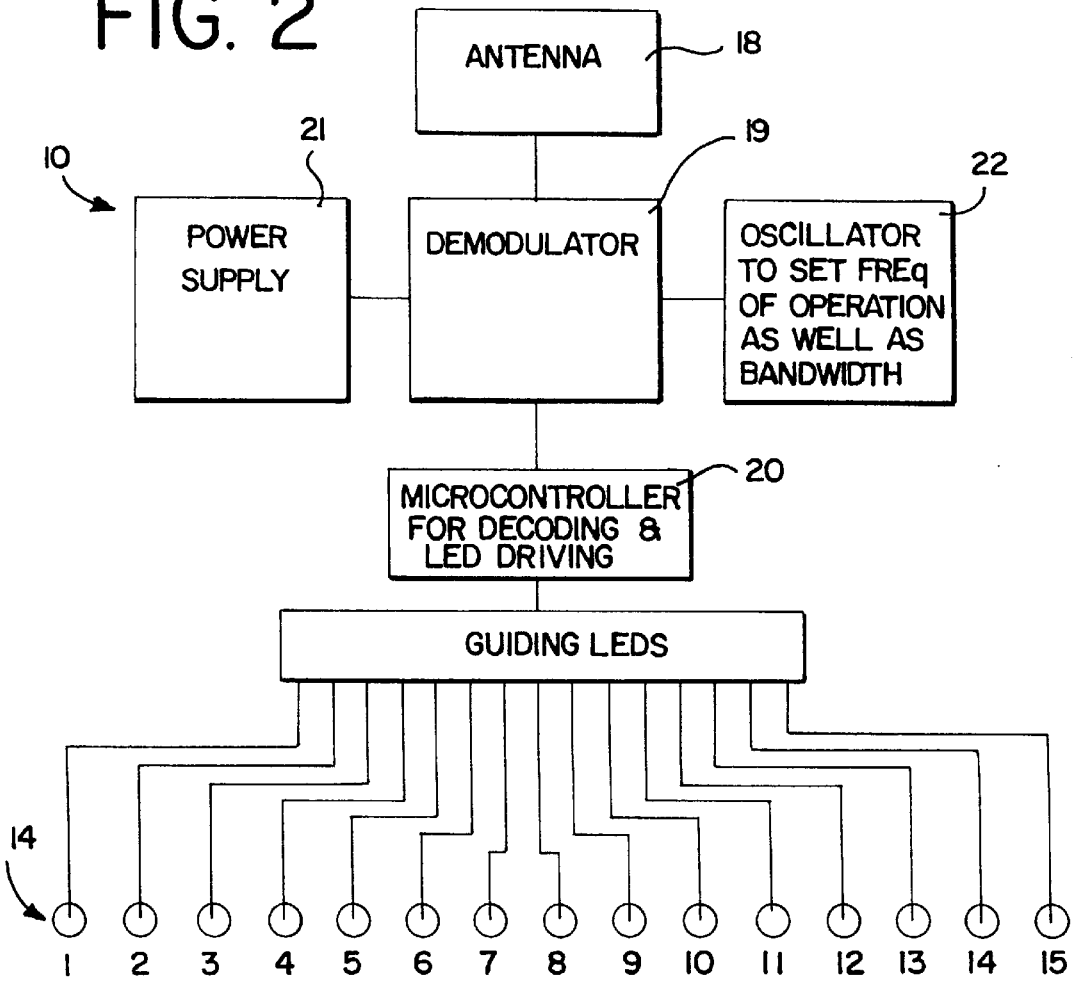
FIG. 2 is a block diagram of the radio receiver shown in FIG. 1.

Each radio receiver, as shown in FIG. 2, includes an antenna 18 for receiving the signal from the transmitters, a demodulator 19 for removing the carrier frequency and feeding the digital code to a microprocessor or microcontroller 20. A power supply 21 is provided to feed the proper power source to the demodulator and other components of the receiver and an oscillator 22 is provided to set the frequency of operation of the receiver as well as the band width. The microcontroller decodes the digital signal and drives the particular LED for which the signal is intended.

The radio receiver requires very low power for operation and may be connected to the power for the cap or helmet lamp of the worker through conductors 23. Preferably, the power source for the cap lamp is in the form of a battery and the battery is connected to the radio receiver and through the radio receiver by the cap lamp by conductors 24. It is appreciated that a separate battery may be provided for the receiver.

Figure 4:
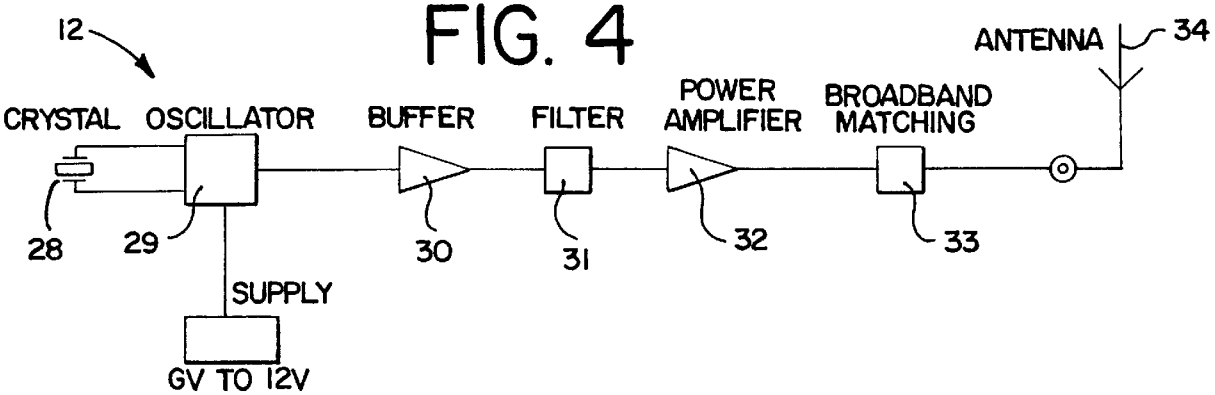
FIG. 4 is a schematic diagram of a radio transmitter according to the invention.

Each radio transmitter, as seen in FIG. 4, includes a crystal 28 connected to an oscillator 29 which in turn is connected to a buffer 30, a filter 31, a power amplifier 32, a broad band matching module 33, and finally an antenna 34. A suitable power supply is provided to power the radio transmitter. Each radio transmitter is set to transmit a signal on the same carrier frequency but with a different digital code.

Figure 3:
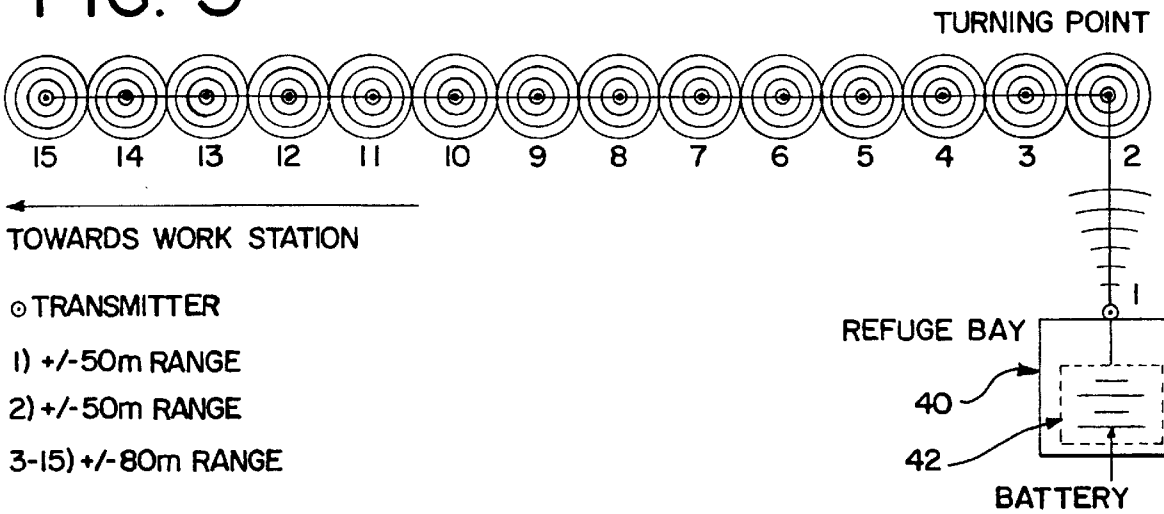
FIG. 3 is a schematic view of a network of radio transmitters used in the rescue guiding system of the present invention.

Referring now to FIG. 3, a network of radio transmitters is shown schematically extending from a work station or area to a refuge bay. The refuge bay is generally indicated by the numeral 40, and each transmitter is designated by the numerals 1 to 15 which correspond to the designation of the LED's in FIGS. 1 and 2. Transmitter No. 1 is located at the entrance to the refuge bay, while transmitter No. 2 is located at the turning point from the main passageway to the branch that goes to the refuge bay. Transmitters 3 to 15 extend from the turning point to the working area or station where the station would be adjacent to transmitter No. 15. It will be appreciated that a worker may also have a work station anywhere along the locations of transmitters 3 to 15. The system will operate to indicate the direction to the refuge bay from any transmitter location. It should also be appreciated that any number of radio transmitters may be used in a network. Preferably, the transmitters 3 to 15 will be spaced apart along a passageway at a spacing of about 80 to 100 meters. Preferably, transmitters 3 to 15 would have a range of about 80 meters, or otherwise be designed for a particular installation. Transmitter No. 2 at the turning point would be closer to transmitter 3 inasmuch as it would preferably have a shorter transmission range of about 50 meters. Similarly, the transmission range of the transmitter 1 at the refuge bay is on the order of 50 meters even if the distance from the turning point is less in order for a worker to understand that the refuge bay is very close.

It will be appreciated that it is preferably to provide power to each of the radio transmitters from a single power source such as a battery 42 located in the refuge bay which would be hard-wired to the refuge bay transmitter and on to the turning point and other transmitters. The power consumption of each radio transmitter is in the milliampere range, and therefore a low power requirement will make each of the radio transmitters operational. It is also preferred that the transmitters be in a continuous state of transmission in order to obtain the most effective results for the system. When setting up the transmitters, the same frequency will be used for all of the transmitters, although each transmitter will transmit a different digital code on that frequency. As noted in FIG. 3, the transmission range of transmitters 2 to 15 is slightly overlapping in order to provide proper operation of the LED's. Similarly, the range of the transmitter at the refuge bay is slightly overlapping with the range of the transmitter at the turning point to the refuge bay.

One form of radio transmitter is shown in FIG. 5, wherein it is mounted in an enclosure 45 having a power on LED 46 which permits inspection to determine operability. The enclosure is carried on a mounting bracket 47 to facilitate mounting of the transmitter along a passageway to the roof structure or along a conveyer support. Each transmitter would include a power-in terminal 48 and a power-out terminal 49 to facilitate the serial connection of the transmitters. The power-in terminal would be either connected directly to the battery power or to an adjacent power-out terminal of a radio transmitter. Thus, suitable conductors would be provided between each of the radio transmitters so they could be connected in parallel to the power source. The network of transmitters from a transmission line may cover any suitable distance such as 1200 meters. Preferably, the distance from the work station to the refuge bay is such as to allow a worker to safely reach the refuge bay in no more than about 20 minutes as the life span of the emergency equipment carried by the worker will normally be no more than 30 minutes and can be somewhat less under conditions where the worker is highly anxious and stressed to properly reach a refuge bay in an emergency condition.

Similarly, the radio receiver may be encapsulated in any suitable enclosure such as one made from a high impact material such as polycarbonate. As above mentioned, the radio receiver may be powered by any portable source of power like batteries and preferably for a mine worker powered from the same source that powers the cap or helmet lamp of the worker. Also, as illustrated in FIG. 1, it is preferable that the LED's are linearly arranged in an order to indicate a certain direction of movement on the successive lighting of the LED's. The shape of the receiver housing or enclosure, while of no particular significance, may be in the shape of an arrow as illustrated. The LED's would be therefore arranged in a line or row with the LED indicating the refuge bay transmitter being at the pointing section of the arrow shaped housing. Also, as above indicated, the refuge bay LED would preferably be green in color, while the turning point LED No. 2 would be yellow in color. The remaining LED's are preferably red in color. It can be appreciated that any color scheme may be used.

In operation, with all of the transmitters powered and transmitting their digitally coded signals and the receivers of the workers being powered, the LED on the receiver matching the transmission of any given transmitter would be energized. If the worker is in the area of the range of transmitter No. 15, the LED marked 15 would be energized due to the specific digital code being transmitted by transmitter 15. Further, if the worker with its receiver is within the range of transmitter 14, LED 14 will also be energized and lit. In the event of an emergency situation such as a fire, where the worker is intending to move in the direction of the refuge bay, the LED's will be sequentially energized during movement along the passageway to indicate to the worker the correct direction the worker should take in reaching the refuge bay. For example, if the worker is moving toward the refuge bay after LED 14 is energized, LED's 13 to 3 will be successively and sequentially energized as the worker advances along the network of transmitters. When the worker comes within the transmission range of the turning point transmitter No. 2, the yellow LED 2 will be energized to indicate to the worker that the turning point to the refuge bay is close and about to be encountered. Should the worker note that the LED's lighting goes from a number such as 10 to 11, the worker will be alerted that the direction is incorrect and will need to turn around and go in the other direction toward the refuge bay. However, should the worker note that LED 9 is lit after LED 10, the worker will understand that the direction of movement is correct to reach the refuge bay.

When the worker reaches the turning point and the yellow LED 2 is lit, the worker may also encounter some additional guidance by way of a wall or rope to indicate the presence of the branch leading to the refuge bay and which would also indicate the direction to turn to go where the refuge bay is located.

Accordingly, it will be seen that the present invention provides a positive and safe system for assuring a worker of heading in the proper direction to a refuge bay in the event of a life-threatening situation and where it may be difficult if at all possible to see where to go because of smoke in the passageway.

It will be understood that modifications and variations may be effected without departing from the scope of the novel concepts of the present invention, but it is understood that this application is to be limited only by the scope of the appended claims.

The invention is hereby claimed as follows:

1. A rescue guiding system for underground mine personnel to guide a person from a work area to a refuge bay, said system comprising:

a network of short-range radio transmitters spaced along a passageway extending from a mine face to a refuge bay, each radio transmitter transmitting a different digitally coded signal, and a radio receiver for each person receiving the coded signals and including an indicating device to indicate the direction the person should take to reach the refuge bay, each receiver having means for decoding the signals and driving the indicating device.

2. The rescue guiding system of claim 1, wherein said refuge bay is located in a branch to the passageway and said network of radio transmitters includes a transmitter at said refuge bay, a transmitter at the turning point to said branch to the refuge bay, and transmitters along the passageway to the work area.

3. The rescue guiding system of claim 2, wherein said system further includes a power source for the transmitters located in the refuge bay and the power source is connected in parallel to the transmitters.

4. The rescue guiding system of claim 1, wherein each radio transmitter comprises a power supply connected to the power source, a crystal, an oscillator, a buffer, a filter, a power amplifier, a signal generator for generating a digitally coded signal, and an antenna.

5. The rescue guiding system of claim 4, wherein the range of the radio transmitters varies.

6. The rescue guiding system of claim 2, wherein the range of the radio transmitters at the turning point and the refuge bay is shorter than the range of the transmitters in the passageway.

7. The rescue guiding system of claim 1, wherein the indicating device of each radio receiver includes a plurality of light emitting diodes (LED's), and means for operating each LED, in response to a digitally coded signal received from one of said transmitters.

8. The rescue guiding system of claim 7, wherein said LED's are sequentially arranged to match the sequential spaced apart order of said transmitters.

9. The rescue system of claim 8, wherein a branch extends from the passageway, and the refuge bay is located in said branch, and the sequential order of said transmitters in the passageway includes a transmitter at the turning point to the branch and a transmitter at the refuge bay.

10. The rescue system of claim 9, wherein the colors of the LED's vary and the color of the LED at the turning point is different from the other LED's and the color of the LED at the refuge bay is different from the other LED's and the LED at the turning point.

11. The rescue system of claim 10, wherein the LED's are linearly arranged, and the next to last one is coded to the turning point transmitter and the last one is coded to the refuge bay transmitter.

12. The rescue system of claim 11, wherein said indicating device further includes indicia means for each LED to identify each LED from the others.

13. The rescue system of claim 7, wherein each transmitter signal includes the same radio frequency and a different digital code and each receiver includes: a microcontroller for decoding the transmitter signals and for driving the LED's, a demodulator for receiving the transmitter signals to eliminate the radio frequency and feed the digital code to the microcontroller, a power supply and an antenna, whereby each digital code operates an LED.

14. The rescue system of claim 13, wherein each receiver further includes an oscillator to set the frequency of operation and the bandwidth.

15. A rescue guiding system for underground mine personnel to guide a person during hazardous life-threatening situations from a work area through a passageway to a refuge bay located in a branch to the passageway, said system comprising:

a network of short-range radio transmitters including a plurality of transmitters spaced apart along the passageway a transmitter at the branch to the refuge bay, and a transmitter at the refuge bay, each radio transmitter operating on the same frequency and transmitting a different digitally coded signal, and a radio receiver for each person, each radio receiver including an LED direction indicator having a plurality of LED's, said receiver further having means to receive each digital coded signal and decode the signal to drive an LED of the indicator to guide the person in the correct direction to take along the passageway to reach the refuge bay.

16. The rescue guiding system of claim 15, wherein the color of the LED's varies to specifically identify the branch transmitter and the refuge bay transmitter.

* * * * *

UNITED STATES PATENT AND TRADEMARK OFFICE

CERTIFICATE OF CORRECTION

PATENT NO. : 6,215,410 B1
DATED : April 10, 2001
INVENTOR(S) : Asher Singer and Andy Steenkamp It is certified that error appears in the above-identified patent and that said Letters Patent is hereby corrected as shown below:

Column 2,
Line 49, change "or" to -- of --

Column 4,
Line 42, change "preferably" to -- preferable --

Signed and Sealed this

Eleventh Day of December, 2001

*Attest:*

Nicholas P. Godici

*Attesting Officer*

NICHOLAS P. GODICI
*Acting Director of the United States Patent and Trademark Office*